US011074901B2

(12) United States Patent
Delpero et al.

(10) Patent No.: US 11,074,901 B2
(45) Date of Patent: Jul. 27, 2021

(54) PHONONIC CRYSTAL VIBRATION ISOLATOR WITH INERTIA AMPLIFICATION MECHANISM

(71) Applicant: EMPA Eidgenössische Materialprüfungs—und Forschungsanstalt, Dübendorf (CH)

(72) Inventors: Tommaso Delpero, Zürich (CH); Andrea Bergamini, Wald (CH)

(73) Assignee: EMPA EIDGENÖSSISCHE MATERIALPRÜFUNGS—UND FORSCHUNGSANSTALT, Dübendorf (CH)

( * ) Notice: Subject to any disclaimer, the term of this patent is extended or adjusted under 35 U.S.C. 154(b) by 456 days.

(21) Appl. No.: 16/096,356

(22) PCT Filed: Apr. 26, 2017

(86) PCT No.: PCT/EP2017/059870
§ 371 (c)(1),
(2) Date: Oct. 25, 2018

(87) PCT Pub. No.: WO2017/186765
PCT Pub. Date: Nov. 2, 2017

(65) Prior Publication Data

US 2019/0130886 A1 May 2, 2019

(30) Foreign Application Priority Data

Apr. 28, 2016 (EP) ..... 16167414

(51) Int. Cl.
*F16F 15/00* (2006.01)
*G10K 11/165* (2006.01)
*G10K 11/04* (2006.01)

(52) U.S. Cl.
CPC ..... *G10K 11/165* (2013.01); *G10K 11/04* (2013.01); *G10K 2210/103* (2013.01);
(Continued)

(58) Field of Classification Search
CPC ..... G10K 11/04; G10K 11/165; G10K 2210/103; G10K 2210/3214; G10K 2210/3219; G10K 2210/3223
(Continued)

(56) References Cited

U.S. PATENT DOCUMENTS 3,516,195 A 6/1970 Batley
8,616,328 B2 12/2013 Daraio et al.
(Continued)

FOREIGN PATENT DOCUMENTS

DE 20317544 U1 4/2004
EP 2779157 A1 * 9/2014 ..... F16F 15/022
(Continued)

OTHER PUBLICATIONS

English translation of International Preliminary Report on Patentability, dated Oct. 30, 2018, with Written Opinion for PCT/EP2017/059870 filed Apr. 26, 2017.
(Continued)

*Primary Examiner* — Ammar T Hamid
(74) *Attorney, Agent, or Firm* — Paul D. Bianco; Gary S. Winer; Fleit Intellectual Property Law

(57) ABSTRACT

A unit cell of an artificial phononic crystal for building of an artificial phononic metamaterial, showing reduced mechanical vibrations in a defined frequency range with at least one band gap in the band structure dispersion relation of the unit cell. The unit cell includes at least one building block and at least one mechanical connection connected to the building block, showing reduced mechanical vibrations in a defined frequency range with tailored dispersion properties with at least one band gap is sought. This is accomplished by
(Continued)

forming the building block as a toroid, with a central opening and a front surface from which a first multiplicity of struts, which are tiltable relatively to the principal direction, is extending from the front surface. More than one strut is inclined with respect to the principal direction so that a rotation of the toroid around the principal direction is possible.

15 Claims, 2 Drawing Sheets

(52) U.S. Cl.
CPC ..... *G10K 2210/3214* (2013.01); *G10K 2210/3219* (2013.01); *G10K 2210/3223* (2013.01)

(58) Field of Classification Search
USPC ..... 181/208, 209
See application file for complete search history.

(56) References Cited

U.S. PATENT DOCUMENTS

| | | | |
|---|---|---|---|
| 8,833,510 | B2 | 9/2014 | Koh et al. |
| 2002/0065175 | A1 | 5/2002 | Walker |
| 2014/0318886 | A1 | 10/2014 | Yano et al. |

FOREIGN PATENT DOCUMENTS

| | | | |
|---|---|---|---|
| EP | 2779157 | A1 | 9/2014 |
| WO | 2005046805 | A1 | 5/2005 |
| WO | 2006/048805 | A1 | 5/2006 |
| WO | 2014160389 | A1 | 10/2014 |

OTHER PUBLICATIONS

Liu. Zhengyou et al.: "Locally resonant sonic materials". Science. vol. 289.5485. 2000, 2 pages.
Baravelli. Emanuele; Massimo Ruzzene: "Internally resonating lattices for band gap generation and low-frequency vibration control". Journal of Sound and Vibration. vol. 332.25. 2013, pp. 6562-6579.
Yilmaz. C.; G. M. Hulbert; N. Kikuchi: "Phononic band gaps induced by inertial amplification in periodic media". Physical Review B. vol. 76 .• No. 5., 2007, 5 pages.
International Search Report dated Jul. 27, 2017 for PCT/EP2017/059870 filed Apr. 26, 2017.
Written Opinion for PCT/EP2017/059870 filed Apr. 26, 2017.
Office Action dated Oct. 24, 2019 from the European Patent Office for Application No. 17 720 447.6, 5 pages.

* cited by examiner

PHONONIC CRYSTAL VIBRATION ISOLATOR WITH INERTIA AMPLIFICATION MECHANISM

TECHNICAL FIELD

The present invention describes an unit cell of an artificial phononic crystal for building of an artificial phononic metamaterial, showing reduced mechanical vibrations in a defined frequency range with at least one band gap in the band structure dispersion relation of the unit cell respectively the metamaterial, where the unit cell comprises at least one building block and at least one mechanical connection connected to the building block reaching through the three dimensional unit cell, an artificial phononic crystal for building metamaterial structure suitable for mechanical vibration isolation, patterned by an array of at least two unit cells build in principal direction and a fabrication method for production of a unit cell or an artificial phononic crystal.

STATE OF THE ART

The capability of carrying quasi-static loads with small associated deformations, while preventing the propagation of structural vibrations is a desirable combination of properties that is not usually found in a single material. In typical structural applications, these two tasks are accomplished by different elements, where the stiffer and stronger element carries the loads, while a damping element is generally responsible for dissipating the energy of the vibration and, thus, for reducing its amplitude.

The attenuation of sound and vibration, especially at low-frequency, is usually obtained by adding to the system mass or materials in which the mechanical energy is dissipated by means of internal loss. The conflict arises from the fact that materials with large values of loss factor are typically characterized by a low value of Young's modulus, and vice versa. This is especially detrimental, when the lightweight attributes of the structure are of interest for the application at hand.

Materials are to be found, showing broadband wave attenuation at low frequencies with frequencies below 20 kHz. This is not possible using natural crystals, showing forbidden frequency domains (band gaps) in the THz range.

The introduction of the concept of metamaterials and phononic crystals, human-made artificial macroscopic crystals, has opened the way to the development of novel materials with advantageous properties that result from the macroscopic arrangement of their building blocks. Indeed, the introduction of an additional level of structure above the atomic scale may lead to the development of macroscopically-structured materials that exceed the typical relations between static, dynamic and mass properties of bulk materials.

The reason for the strong fascination with structured materials is justified by the possibility to design their building blocks in order to obtain peculiar properties, which originate from the way mechanical waves propagate through them. One of the main properties of interest is the possibility of featuring phononic band gaps, i.e. selected ranges of frequency where mechanical waves are prevented from being transmitted through them. When waves cannot propagate, a high steady-state vibration level (originating from the interaction of the waves with the system's boundaries, such that standing waves are formed) cannot build and such systems will always feature a low-amplitude vibration response in correspondence of the band gap frequency range.

Metamaterials with subwavelength energy absorption capabilities, i.e. whose band gaps start at frequency substantially smaller than the wave speed of the medium divided by the characteristic length of the lattice, have been proposed in Liu, Zhengyou, et al. "Locally resonant sonic materials." Science 289.5485 (2000): 1734-1736. The attenuation bands are obtained by exploiting micro-scale resonators, consisting of small spherical masses resonating in a soft matrix, that absorb energy on the macro-scale. In this concept, the resonating spheres behave as point-masses and do not take advantage of any inertia amplification mechanism. The frequency, depth and width of the attenuation bands are limited by the mass of the resonating spheres. Therefore, to obtain wide band gaps at low frequencies, one needs heavy resonators that form a large fraction of the overall mass of the medium.

A structural concept for high stiffness and high damping performance has been proposed in Baravelli, Emanuele, and Massimo Ruzzene. "Internally resonating lattices for band gap generation and low-frequency vibration control." Journal of Sound and Vibration 332.25 (2013): 6562-6579, where a stiff external frame and an internal resonating lattice are combined in a beam-like assembly. This concept achieves large vibration attenuation at low frequency thanks to the chiral arrangement of the internal lattice, whose complex deformation mechanism allows for exploiting both the translational and rotational inertias of the resonating masses. However, the rotation of the masses occurs in the same plane where the mechanical waves propagate, so that a larger rotational inertia can only be obtained at the cost of a larger size of the building block and, correspondingly, a larger characteristic length of the lattice, with inevitable consequences for the dispersion properties of the system.

Another phononic crystal with inertia amplification mechanism has been proposed in Yilmaz, C., G. M. Hulbert, and N. Kikuchi. "Phononic band gaps induced by inertial amplification in periodic media.", Physical Review B 76.5 (2007): 054309. The attenuation band, rather than being caused by local resonances, arises from the destructive interference of the wave scattered by the periodic inclusions within the medium. This mechanism (Bragg-scattering) typically leads to broader band gaps compared to local resonators, even if the starting frequency of the attenuation band is of the same order of magnitude of the wave speed of the medium divided by the lattice constant. The peculiarity of the concept proposed is that the effective inertia of the wave propagation medium is amplified via embedded amplification mechanisms, so that the wave speed of the medium and the band gap starting frequency are reduced. The concept proposed in Yilmaz, C., G. M. Hulbert, and N. Kikuchi. "Phononic band gaps induced by inertial amplification in periodic media.", Physical Review B 76.5 (2007): 054309 is however based on point masses and idealized amplification mechanisms, and do not consider the rotational inertia of the masses.

U.S. Pat. No. 8,833,510 refers to a design methodology for generic structured phononic metamaterials, comprising a multiplicity of unit cells, that enable the manipulation of both elastic and acoustic waves in different media, from attenuation (including absorption and reflection) to coupling, tunneling, negative refraction and focusing. In some mesoscale devices the presence of such vibrations affects the intended performance of the device or entity in question. By tuning structural details of the unit cells, comprising building blocks and mechanical connections and trying different materials for the unit cell elements, the band structure dispersion relation of the phononic metamaterial could be varied.

Human-made macroscopic crystals respectively artificial phononic metamaterials, regularly patterned by a multiplicity of unit cells for building macroscopic structures respectively metamaterials or devices comprising such metamaterials are desired, wherein vibration dispersion properties can be tailored for different applications. But the results reached so far, especially band gaps at low acoustic frequencies between 100 Hz and 5 kHz were not sufficient.

DESCRIPTION OF THE INVENTION

The object of the present invention is to create a unit cell of an artificial phononic crystal for building of an artificial phononic metamaterial, showing reduced mechanical vibrations in a defined frequency range with tailored dispersion properties with at least one band gap in the band structure dispersion relation of the unit cell respectively the metamaterial, bringing the band gap to the 10 Hz-5 kHz range.

Another object is to find a unit cell with a smaller unit cell size, with optional possibilities for tuning vibration attenuation.

Artificial phononic crystals respectively metamaterials should be achieved showing broader band gaps, with a more favorable relation between the band gap starting frequency and the mass density of the artificial phononic metamaterial.

These problems could be solved with the unit cells, respectively by introducing the specific construction elements of the unit cells claimed.

Due to the used materials and construction of the unit cells a lightweight phononic metamaterial, usable for building phononic structures for different applications, with a desired quasi-static stiffness could be achieved.

The proposed unit cells and resulting phononic crystals exhibit strong vibration attenuation capabilities at low acoustic frequencies, below 5 kHz along at least one specific direction, while offering low mass density, high quasi-static stiffness and small characteristic length. The attenuation characteristics is reached by the chosen geometry of the unit cells.

Another object of the subject matter of the invention is to provide a manufacturing method for producing unit cells, artificial phononic metamaterials and phononic metamaterial devices comprising an array of a multiplicity of unit cells.

BRIEF DESCRIPTION OF THE DRAWINGS

A preferred exemplary embodiment of the subject matter of the invention is described below in conjunction with the attached drawings.

FIG. 2A shows a schematic perspective view of a unit cell according to the invention, while

DESCRIPTION

Figure 1A:
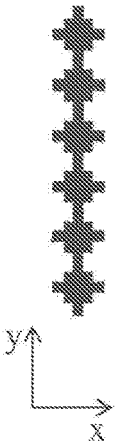
FIGS. 1A and 1B show prior art unit cells of artificial phononic metamaterial in a perspective view.
Figure 1B:
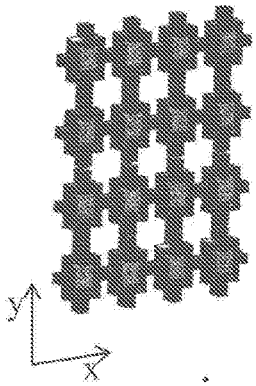
Figure 1C:
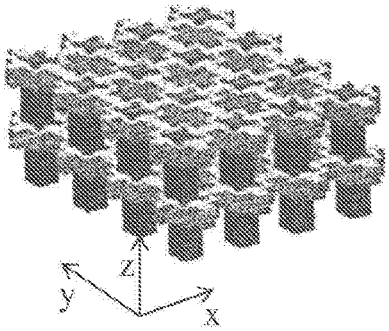
prior art FIG. 1C

The main challenge related to the design of artificial phononic crystals 2 or acoustic or artificial phononic metamaterials comprising such artificial phononic crystals 2 is to find the geometry of a unit cell 1 that allows for an appropriate combination of broad low-frequency band gaps, low mass density, high quasi-static stiffness and small size of the unit cells 1. A multiplicity of unit cells 1 builds the artificial phononic crystal 2 with an array of unit cells 1.

In the case of phononic crystals 2, these four properties are strictly related: for a given topology of the crystal, lower frequency band gaps can be obtained by increasing its mass density and characteristic length or by decreasing its quasi-static stiffness. Local resonators, even if they allow for subwavelength band gaps, are also subject to similar conflicting requirements: relatively heavy resonators and large filling ratios/volume fractions are still needed for low-frequency and wide band gaps. The introduction of inertia amplification mechanisms in structured materials may help in overcoming this conflicting relation between mass density, stiffness, characteristic length and frequency.

With the unit cell 1 described here a unit cell 1 respectively a phononic crystal 2, comprising a multiplicity of unit cells 1 could be reached featuring an inertia amplification mechanism based on rotational inertia, where the rotation occurs in a x-y-plane perpendicular to a wave propagation direction z. The wave propagation direction z or principal direction z is defined, along which the unit cell 1 required to exhibit strong attenuation capabilities while offering high quasi-static stiffness and small characteristic length. The wave propagation is indicated in principal direction z from the "IN" to "OUT"-marking through the unit cell 1 respectively the phononic crystal 2.

The unit cell 1 comprises at least one building block 10 and a multiplicity of mechanical connections 11. In particular the building block 10 is a discoid or toroid or ellipsoid 10 in particular a torus 10 with circular cross section or a toroid with square cross section, forming a ring 10. The building block 10 could also be formed like a toroidal polyhedron 10. As shown in the figures, the building block 10 is formed in particular in form of a torus 10 (FIG. 2A) or a ring 10 (FIG. 3) with a central opening 100. The building block 10 is extending in the x-y-plane, in a plane in particular perpendicular to principal direction z, while the principal direction z runs through the central opening 100. The principal direction z of the unit cell 1 equals the later wave propagation direction and vibration attenuation direction.

At the building block 10, at the surface of the torus 10 or ring 10, the multiplicity of mechanical connections 11 is connected to the building block 10 on a front surface f of the ring 10. The mechanical connections 11 are in particular formed as struts 11, which are connected to the surface of the building block 10 extending substantially parallel to the principal direction z from the front surface f of the building block 10 of the unit cell 1. Good results were achieved with three struts 11. Each strut 11 is tiltable relatively to the building block 10 and the principal direction z. The struts 11 are extending nearly parallel to the principal direction z or is inclined at an angle $\alpha$ to the x-direction and/or $\beta$ to the y-direction of the x-y building block plane.

The struts 11 are rigid elements, which have to be stiff and light in order not to have local eigenmodes within the bandgap frequency range. Hollow cross sections of the struts 11 would therefore be beneficial in this direction, but may imply an unwanted manufacturing complication. A more important parameter of the struts 11 is their inclination with respect to the z-direction.

The struts 11 are evenly distributed connected along the periphery of the building block 10 facing at least in the principal direction z. The struts 11 are bendable relatively to the building block 10 respectively to the principal direction z. The bending compliance may be concentrated in hinges (possibly represented by solid state hinges) in proximity of the connection of the strut to 10.

The largest portion of the crystal's inertia is concentrated in the rotation of building blocks 10, for example in form of rings 10, which occurs in the x-y plane perpendicular to the principal direction z. This solution allows for decoupling the space required by large rotational inertias from the need to limit the characteristic length in the wave propagation direction z. The inertia amplification mechanism is driven by the chiral arrangement of struts 11 that couples the deformation along the principal direction z with the rings' 10 rotation.

Figure 2A:
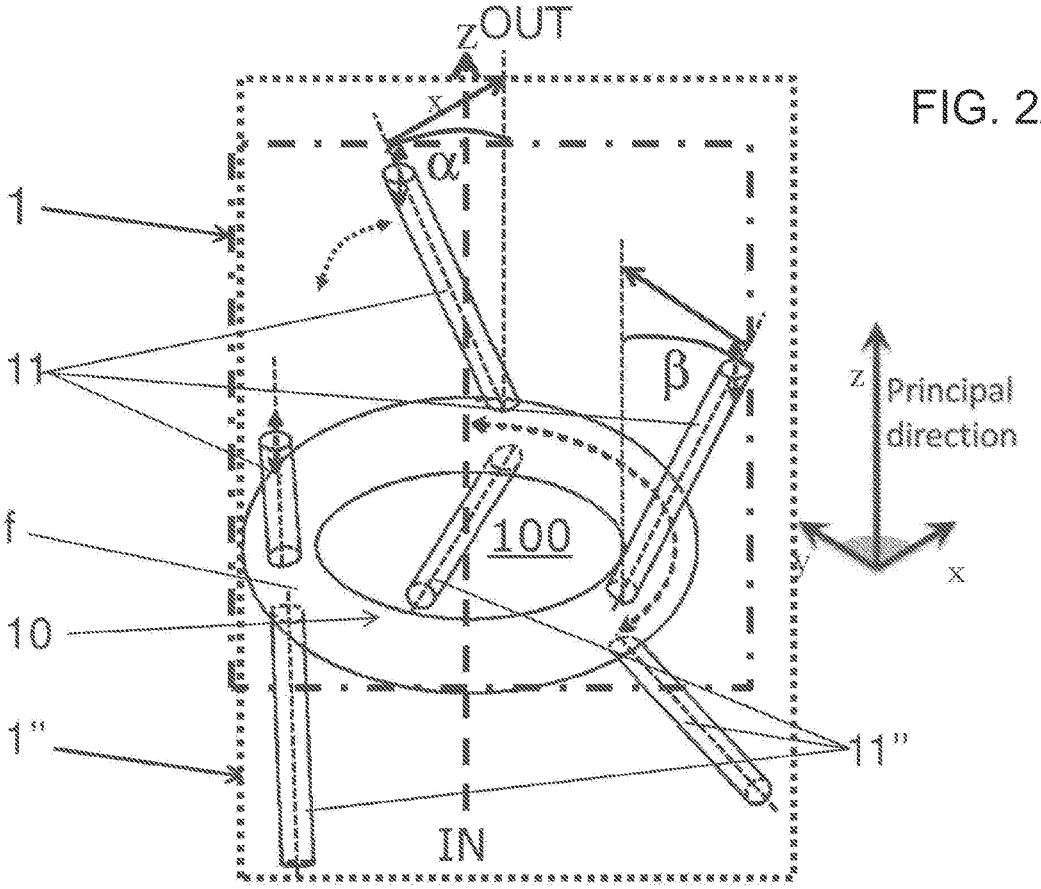

A deformation along the principal direction z of the unit cell 1 respectively a crystal 2 built by unit cells 1 indicated with the double arrows in FIG. 2*a*, due to wave propagation in principal direction z, causes a rotation of the central ring 10. This rotation about the principal direction z is also indicated with a double arrow in FIG. 2A.

The ratio between this rotation in x-y plane and the longitudinal deformation defines the inertia amplification factor and is defined by the inclination by angles $\alpha$ and/or $\beta$ of the struts 11 with respect to the principal direction z. The quasi-static stiffness is defined by the bending stiffness of the struts 11 and their inclination by angles $\alpha$ and/or $\beta$ of the struts 11.

FIG. 2A also shows a slightly modified unit cell 1", comprising all elements of the above mentioned unit cell 1 extending in principal direction z. While the struts 11 are sticking out of the building block surface in positive z-direction from the front surface f of building block 10, a second multiplicity of struts 11" is protruding from the rear surface side of the building block 10 in the negative z-direction. The inclination of the struts 11 of the first multiplicity is chiral to the inclination of the struts 11" of the second multiplicity, means mirror-inverted.

Arrays of the disclosed unit cells 1 can build a phononic crystal 2 vibration isolator with inertia amplification mechanism, due to the construction of the unit cell 1.

Figure 2B:
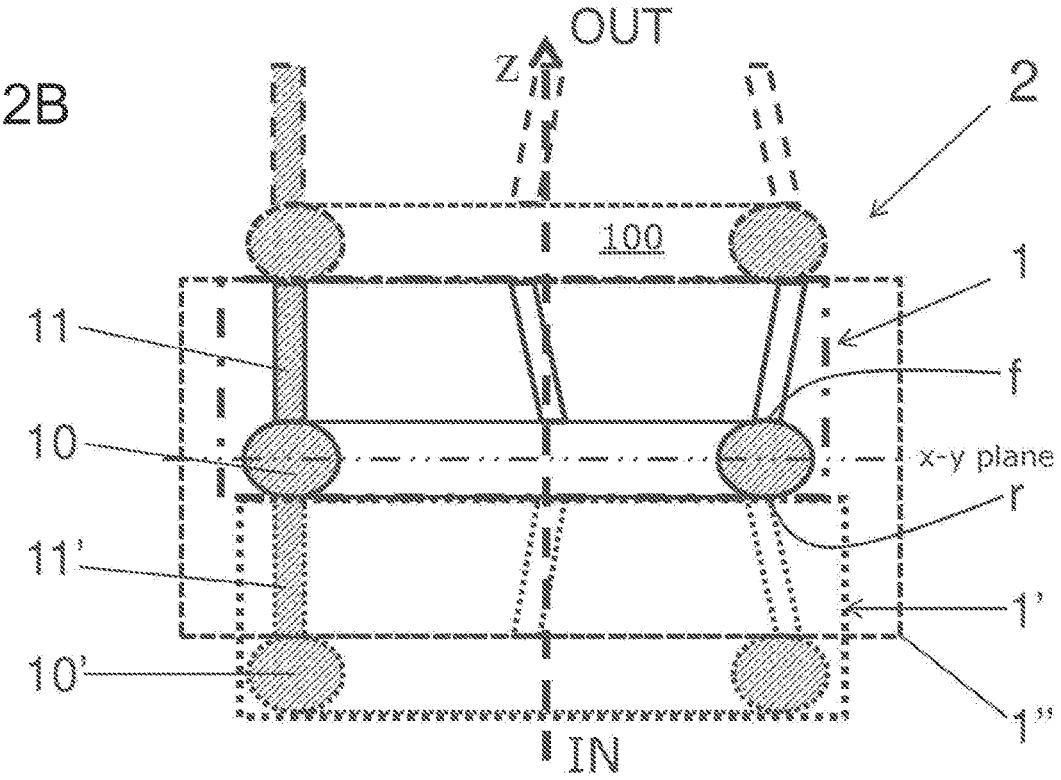
FIG. 2B shows a sectional view in x-z-direction of a phononic crystal with an array of unit cells according to FIG. 2A.

A phononic crystal 2 is formed by an array of at least two unit cells 1, 1', 1" as depicted in FIG. 2B or a multiplicity of unit cells 1". If an array of unit cells 1, 1', 1" is formed, it is preferred, that the struts 11, 11' of directly neighbouring unit cells 1, 1' are arranged in a chiral arrangement at the front surface f and a rear surface r of the building block 10. As shown in FIG. 2B the inclination a, 13 of at least two struts 11, 11' of the first unit cell 1 and the directly neighboured unit cell 1' are chiral. Chiral means, that after a reflection of the first unit cell 1 about the x-y plane, the struts 11 of the first unit cell 1 are congruent to the struts 11' of the second unit cell 1'.

The possible band gap starting frequency is defined by the rotational inertia of the central ring 10 and the quasi-static stiffness of the whole crystal 2. The actual phononic crystal 2 featuring the attenuation band is obtained by repeating the unit cell 1, 1', 1" in space, according to a periodic lattice arrangement.

Figure 3:
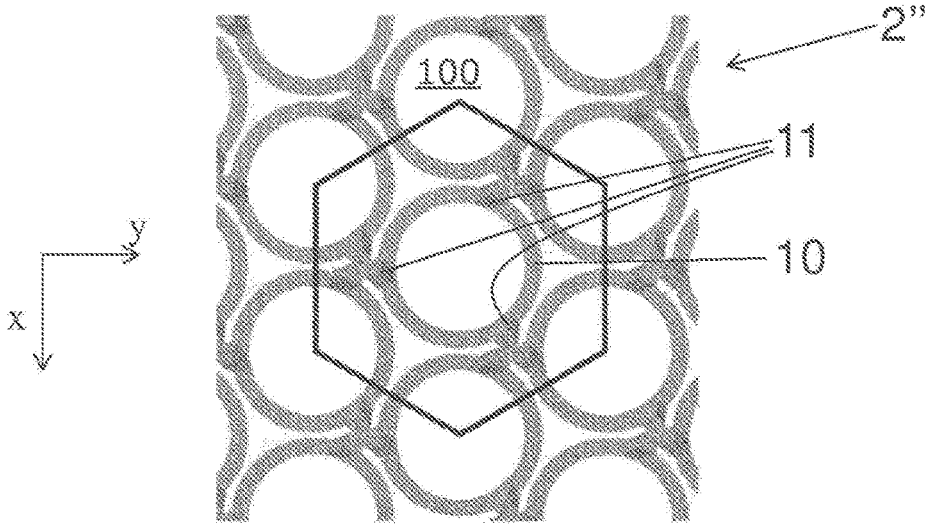
FIG. 3 shows a top view of a multiplicity of unit cells in x-y plane arranged in a hexagonal closed pack lattice structure.

All unit cells 1, 1', 1" described here in particular fit to a Hexagonal Close Packed lattice, as can be seen in FIG. 3 marked with the hexagon. The unit cells 1, 1', 1" can be easily modified to fit also other crystal lattices building the phononic crystal 2 by an array of unit cells 1.

In order to obtain the desired vibration attenuation for example in mechanical engineering along the principal direction z, numerical and experimental results showed that a multiplicity of at least two unit cells 1 in this direction z should be used. The larger the number of unit cells 1, the stronger the attenuation, at the cost of a larger overall length of the final phononic crystal 2 respectively phononic metamaterial structure.

Examples

The actual properties of the phononic crystal 2 depend on the bulk material used to manufacture it and its sizing. For instance, the proposed crystal 2, formed by two unit cells 1", when realized with a thermoplastic polymer like polyamide, can be sized to obtain a band gap in the 200 Hz-1000 Hz frequency range, while exhibiting a quasi-static stiffness in the principal direction z of about 1 MPa, a mass density of 100 kg/m^3 and a characteristic length of 50 mm.

Of course the number of unit cells 1, 1" in the x-y plane could be adapted to the requested phononic crystal 2. A higher number of unit cells 1, 1" in the x-y plane stabilizes the crystal 2 in the x-y plane. The main contribution of the neighbouring unit cells 1, 1', 1" in the x-y plane prevents the rotation of {001} planes of the crystal.

Compared to the solutions presented in the State of the Art, the here proposed artificial phononic metamaterial offers several advantages: Unlike local resonant crystals only exploiting point masses, the proposed artificial phononic metamaterial takes also advantage of the rotational inertia of a ring-like element. This more efficient exploitation of the mass in the crystal leads to generally broader band gaps and to a more favorable relation between the band gap starting frequency and the mass density of the crystal.

Unlike other arrangements, the rotation of the inertia amplification mechanism occurs in a plane perpendicular to the wave propagation direction, so that a better relation between the band gap starting frequency and the characteristic length of the crystal is obtained.

Additionally, the mechanism at the base of the attenuation is not the energy dissipation due to the material damping of the internal lattice, but the interference between the propagating waves (Bragg-scattering). The proposed crystal does not need to include lossy and soft materials like the internal lattice of prior art solution.

With the here presented unit cells 2 and the connected amplification mechanism, the proposed crystals exploit the available space in all the three dimensions. The inertially amplified masses are not limited to point masses, but the space available in the plane perpendicular to the wave propagation direction is used to obtain large inertias, without affecting the characteristic length of the crystal in the principal direction.

The anisotropy of the proposed crystal is the additional degree of freedom that leads to large inertia amplification factors and to a favorable relation between all the effective mechanical properties of the crystal.

Applications

Potential applications of the presented unit cells 1 respectively the phononic crystal 2 as part of artificial phononic metamaterial structures respectively phononic metamaterial devices are in the field of:

- Automotive: engine mount with strong vibration isolation performance,
- Submarines and other vessels: isolation of propulsion units or any potential source of vibration or impact from the hull.
- Machine foundation: isolation of rotating or reciprocating machines to prevent the propagation of unwanted noise and vibrations into the neighbouring environment.
- Precision instruments: protection of precision instruments from dangerous or disturbing vibrations.

Aerospace: isolation of cabin, seats or any vibration sensitive components from vibrations originating from rotary machinery (such as turbines or rotors) or from aerodynamic noise Room Acoustics: Targeted filtering of selected frequency ranges transmitted across a partitioning elements to reduce noise level or to reduce intelligibility of speech.

In all these potential applications, the peculiarity of the presented invention lies in the combination of strong vibration isolation performance at target frequencies with quasi-static load-carrying capabilities.

Manufacturing

For manufacturing of the presented unit cells 1, phononic crystals 2 and artificial phononic metamaterial structures, additive manufacturing techniques are definitely suitable solutions. Although the geometry is relatively complex, 3d printing techniques can accomplish production of different unit cells 1, with suitable sizes for manufacturing tuned phononic crystals 2 for different applications. Even mixing of printed materials is possible.

LIST OF REFERENCE NUMERALS

1 unit cell
- 10 building block
  - 100 central opening
  - x-y building block plane
  - x, y coordinate axis building block plane
  - f front surface
  - r rear surface
- 11 strut
  - α, β angles of inclination of struts
  - 111 hinge
  - z principal direction

2 phononic crystal/array of unit cells

The invention claimed is:

1. A unit cell of an artificial phononic crystal for building of an artificial phononic metamaterial, showing reduced mechanical vibrations in a defined frequency range with at least one band gap in the band structure dispersion relation of the unit cell respectively the metamaterial, the unit cell comprising at least one building block and at least one mechanical connection connected to the building block reaching through the three dimensional unit cell, wherein the at least one building block is a discoid, ellipsoid or toroid, arranged at least partly rotatable around a principal direction, wherein the building block has a front surface from which a first multiplicity of mechanical connections in form of struts, which are tiltable relatively to a building block plane and the principal direction, is extending approximately parallel to the principal direction from the front surface, and wherein more than one strut is inclined with respect to the principal direction, so that the at least partly rotation of the toroid around the principal direction is possible.

2. The unit cell according to claim 1, wherein the building block is a torus with an elliptic or circular cross section or a toroid with a rectangular cross section.

3. The unit cell according to claim 1, wherein the building block has a central opening.

4. The unit cell according to claim 2, wherein the building block is a toroid with a rectangular cross section and the toroid is a toroidal polyhedron.

5. The unit cell according to claim 1, wherein a second multiplicity of struts protruding from a rear surface of the building block, which are tiltable relatively to the building block plane and the principal direction extending approximately parallel to the principal direction is connected to the building block, wherein the struts of the second multiplicity of struts are arranged chiral to the struts of the first multiplicity of struts.

6. The unit cell according to claim 1, wherein the struts are evenly distributed along the periphery of the building block at the front surface and/or the rear surface facing in the principal direction.

7. The unit cell according to claim 1, wherein the multiplicity of struts comprises three struts.

8. The unit cell according to claim 1, wherein the struts have hollow cross sections.

9. The unit cell according to claim 1, wherein the struts are connected at the front surface and/or the rear surface of the at least one building block via hinges, simplifying a toppling of the struts relative to the principal direction.

10. The unit cell according to claim 1, wherein all unit cell elements are made of a polymer, in particular polyamide.

11. The unit cell according to claim 1, wherein the length of the unit cell in principal direction below 150 millimeter, most preferred equal or below 75 millimeter, exhibiting a quasi-static stiffness in the principal direction z of about 1 MPa and has a mass density of 100 $kg/m^2$.

12. An artificial phononic crystal for building metamaterial structure suitable for mechanical vibration isolation, patterned by an array of at least two unit cells build in principal direction according to claim 1, wherein the multiplicities of in principal direction directly neighboured struts are showing a chiral arrangement, with protrusion of the struts in differently inclined directions relatively to the principal direction, so that at least partly rotation of each toroid around the principal direction is simplified.

13. The artificial phononic crystal according to claim 12, wherein the unit cells are arranged in a Hexagonal Close Packed lattice.

14. A fabrication method for production of a unit cell according to claim 1, wherein additive manufacturing techniques are used.

15. A fabrication method for production of an artificial phonon crystal according to claim 12, wherein additive manufacturing techniques are used.

* * * * *